US010442585B2

(12) United States Patent
Beilke et al.

(10) Patent No.: US 10,442,585 B2
(45) Date of Patent: Oct. 15, 2019

(54) CLOSURE FOR A CONTAINER

(71) Applicant: AptarGroup, Inc., Crystal Lake, IL (US)

(72) Inventors: Stacy Beilke, Eagle, WI (US); Phillip Burn, North Prarie, WI (US); Dominic Squillaci, Lake Villa, IL (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 15/753,832

(22) PCT Filed: Nov. 11, 2015

(86) PCT No.: PCT/US2015/060138
§ 371 (c)(1),
(2) Date: Feb. 20, 2018

(87) PCT Pub. No.: WO2017/082892
PCT Pub. Date: May 18, 2017

(65) Prior Publication Data

US 2018/0244440 A1 Aug. 30, 2018

(51) Int. Cl.
*B65D 47/20* (2006.01)
*B65D 47/08* (2006.01)
(Continued)

(52) U.S. Cl.
CPC ..... *B65D 47/2031* (2013.01); *B65D 47/0804* (2013.01); *B65D 47/0838* (2013.01); *B65D 53/02* (2013.01); *B65D 53/04* (2013.01)

(58) Field of Classification Search
CPC ..... B65D 47/2031; B65D 47/0804; B65D 47/0838; B65D 53/02
(Continued)

(56) References Cited

U.S. PATENT DOCUMENTS 4,506,809 A * 3/1985 Corsette ..... B65D 47/2081 222/213
5,632,420 A 5/1997 Lohrman et al.
(Continued)

FOREIGN PATENT DOCUMENTS

CA 2341438 A1 3/2000
WO 9845184 A 10/1998

OTHER PUBLICATIONS

International Search Report and Written Opinion for PCT Appln. No. PCT/US2015/060138, of which the present application is a U.S. National Phase Application.

*Primary Examiner* — Vishal Pancholi
(74) *Attorney, Agent, or Firm* — Wood, Phillips, Katz, Clark & Mortimer

(57) ABSTRACT

A closure 100 is provided for a container 104. The closure 100 has a base 112 for being installed at the opening of the container 104 interior and has open ends defining an access passage 148 extending between the open ends. The closure 100 has a liner 166 disposed between the closure base 112 and the container opening, and the liner 166 has an internal edge 214 defining a central hole. The closure 100 has a valve 160 for being located at the closure access passage 148. The valve 160 has (i) a closed configuration for occluding the access passage 148; and (ii) an open configuration for permitting communication through the access passage 148. The closure 100 has a retainer 170 for retaining the valve 160 at the closure access passage 148, and the retainer 170 has an outer surface with at least one liner abutment 186 extending therefrom for inhibiting contact between the liner internal edge 214 and the contents of the container 104.

15 Claims, 16 Drawing Sheets

(51) Int. Cl.
*B65D 53/02* (2006.01)
*B65D 53/04* (2006.01)

(58) Field of Classification Search
USPC ..... 222/153.14, 380, 387, 490, 493, 494, 222/498, 520, 521, 546, 556
See application file for complete search history.

(56) References Cited

U.S. PATENT DOCUMENTS

| | | | | | |
|---|---|---|---|---|---|
| 5,680,969 | A * | 10/1997 | Gross | B65D 47/2031 | 222/494 |
| 5,769,253 | A * | 6/1998 | Gross | B65D 47/0814 | 215/235 |
| 5,797,523 | A * | 8/1998 | Gross | B65D 47/0861 | 222/498 |
| 5,938,086 | A | 8/1999 | Gross | | |
| 6,095,382 | A * | 8/2000 | Gross | B65D 47/242 | 215/271 |
| 6,112,952 | A * | 9/2000 | Hess, III | B05B 11/0072 | 137/614.2 |
| 6,176,399 | B1 * | 1/2001 | Schantz | B65D 47/2031 | 222/484 |
| 6,446,844 | B1 | 9/2002 | Gross | | |
| 7,117,654 | B2 | 10/2006 | Danks | | |
| 7,721,901 | B1 | 5/2010 | Von Spreckelsen et al. | | |
| 8,070,014 | B2 | 12/2011 | Wisniewski | | |
| 8,573,423 | B2 | 11/2013 | McGeough et al. | | |
| 2007/0267451 | A1 * | 11/2007 | Robinson | B65D 35/38 | 222/546 |
| 2009/0050648 | A1 | 2/2009 | Wisniewski | | |
| 2013/0026168 | A1 * | 1/2013 | Mazurkiewicz | B65D 47/0814 | 220/254.1 |

* cited by examiner

CLOSURE FOR A CONTAINER

CROSS-REFERENCE TO RELATED APPLICATION(S)

Not Applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

This invention relates to a closure for a container.

BACKGROUND OF THE INVENTION AND TECHNICAL PROBLEMS POSED BY THE PRIOR ART

There are a variety of types of conventional closures for containers. One type of closure includes a body or base for being attached to an open end or mouth of a container that may contain contents such as a product—the closure, container, and product together defining a "package". Products contained within the container may be fluent products, as well as non-fluent products.

A closure can be molded or otherwise manufactured from a suitable material (e.g., a thermoplastic material). Such a closure typically has a hollow body or base that, when installed at the open end of the container, defines an opening or access passage to the container interior. Such a closure typically includes a lid (which may or may not be hingedly mounted on the closure base) that can be lifted up to expose the container open end.

For some types of products, it can be desirable to provide a closure that has a valve with: (1) an unpressurized, closed condition for occluding the hollow closure body; and (2) a pressurized, open condition for allowing product to be dispensed from, or accessed within, the container interior through the hollow closure body.

With some such closures, a membrane or liner may be disposed across a lower portion of the closure and the container open end to seal the product from the ambient environment. Some liners may have one or more cut or exposed edges that are exposed to the open interior of the container. Such exposed liner edges may come into contact with the contained product. The inventors of the present invention have found that some liners having a metal component (e.g., aluminum), used on a container of an acidic product (e.g., ketchup), may cause undesirable changes to the acidic product (e.g., discoloration, taste changes) when the exposed metallic liner edge interacts with the acidic product.

The inventors of the present invention have determined that it would be advantageous to provide an improved closure with a liner for a container. In particular, the inventors have discovered that this innovative closure design provides advantages not heretofore contemplated in the packaging industry or suggested by the prior art.

BRIEF SUMMARY OF THE INVENTION

According to the present invention, an improved closure is provided for a container having an opening to the interior of the container wherein contents may be stored. The closure has a base with open ends defining an access passage extending between the open ends. The base accommodates installation at the opening of the container interior to permit communication between the container interior to the exterior of the container. The closure has a liner for being disposed between the closure base and the opening of the container, and the liner has an internal edge defining a hole. The closure has a valve located at the closure access passage, and the valve has: (i) a closed configuration for occluding the access passage; and (ii) an open configuration for permitting communication between the interior and the exterior of the container through the access passage. The closure has a retainer for retaining the valve at the closure base access passage. The retainer has an outer surface with at least one liner abutment extending therefrom for minimizing contact between the liner internal edge and the container contents when the closure is installed on the container.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only specific forms as examples of the invention. However, the invention is not intended to be limited to the embodiments so described.

For ease of description, the closure of this invention is described in a generally upright orientation that it could have at the upper end of a container when the container is stored upright on its bottom or base. It will be understood, however, that the closure of this invention may be manufactured, stored, transported, used, and sold in orientations other than those shown.

The closure of this invention is suitable for use with a variety of conventional or special systems or containers having various designs, the details of which, although not illustrated or described, would be apparent to those having skill in the art and an understanding of such containers. With respect to the illustrated embodiments of the closure of this invention described herein, the container, per se, forms no part of, and therefore is not intended to limit, the broadest aspects of the present invention. It will also be understood by those of ordinary skill that novel and non-obvious inventive aspects can be embodied in the described exemplary closures alone.

One embodiment of a closure of the present invention is illustrated in FIGS. 1-6 where it is designated generally therein by reference number 100. This first embodiment of the closure 100 is initially provided as a separately manufactured article for mounting to the top of a system, such as a bottle or container 104.

The container 104 typically has a mouth or open end 108 (FIG. 3) which provides access to the container interior where the contents, such as a product, may be contained. The product may be, for example, ketchup, jelly, etc., which can be dispensed or poured from a container by upending the container or pressurizing a portion of the container. The product may also be a less fluent material that can be stirred or removed with a utensil, such as nuts, candies, powders, slurries, etc. Such materials may be sold, for example, as a food product, a personal care product, an industrial or household product, or other substance (e.g., for internal or external use by humans or animals, or for use in activities involving medicine, manufacturing, commercial or household maintenance, construction, agriculture, etc.). The closure 100, container 104, and contents of the container 104 assembled together are referred to generally herein as a "package", which would be typically be encountered by a customer or user.

Figure 5:
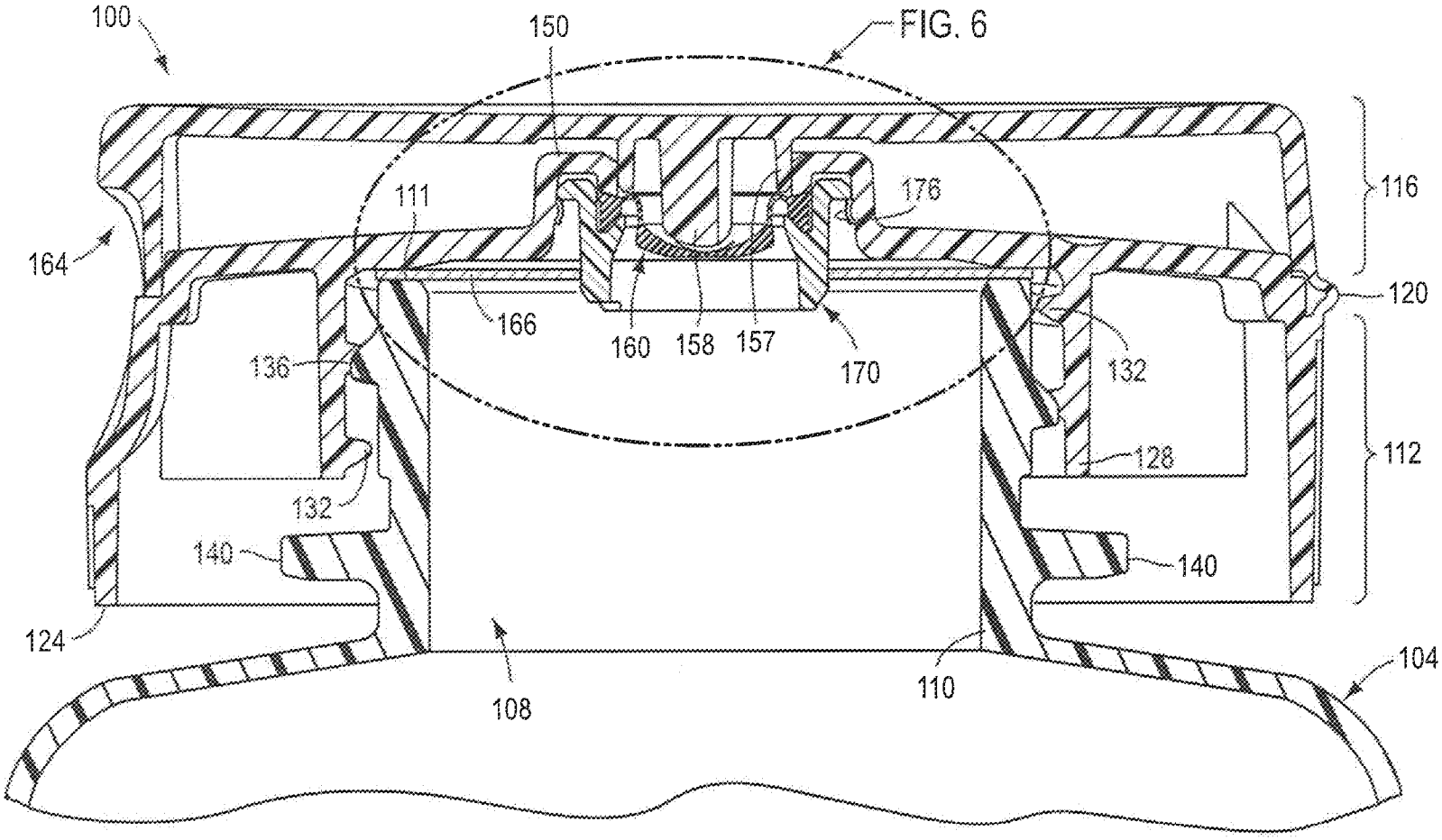
FIG. 5 is a fragmentary, cross-sectional view of the package taken along the plane 5-5 in FIG. 1.

The particular illustrated container 104 has a reduced size upper portion or neck 110 with an upper end 111. However, if desired, the upper end 111 of the container 104 need not have a discernible neck 110 and may have other suitable structures that define the container open end 108 with a cross-sectional configuration with which the closure 100 is adapted to engage. Although not illustrated, the body of the container 104 below the neck 110 may have a cross-sectional configuration that is uniform with the cross-sectional configuration of the container open end 108. On the other hand, as is the case with the illustrated container 104, the container 104 may have a non-uniform shape along some of its length or height, with a neck 110 of any significantly reduced size or significantly different cross-section. As can be seen in FIG. 5, the neck 110 includes an external thread 136 and an optional flange 140 extending radially outwardly below the thread 136.

The container 104 may or may not be a squeezable container having a flexible, resilient wall or walls which can be grasped by the user and compressed somewhat (i.e., temporarily, elastically deformed). The illustrated embodiment of the closure 100 is especially suitable for use with a container 104 having a wall that is intended to be temporarily squeezed inwardly by the user. While the closure 100 is illustrated as having a generally cylindrical shape, it will be appreciated that the closure 100 may have a variety of shapes such as polygonal or irregular volumes depending on the functional or aesthetic design of the package.

Figure 1:
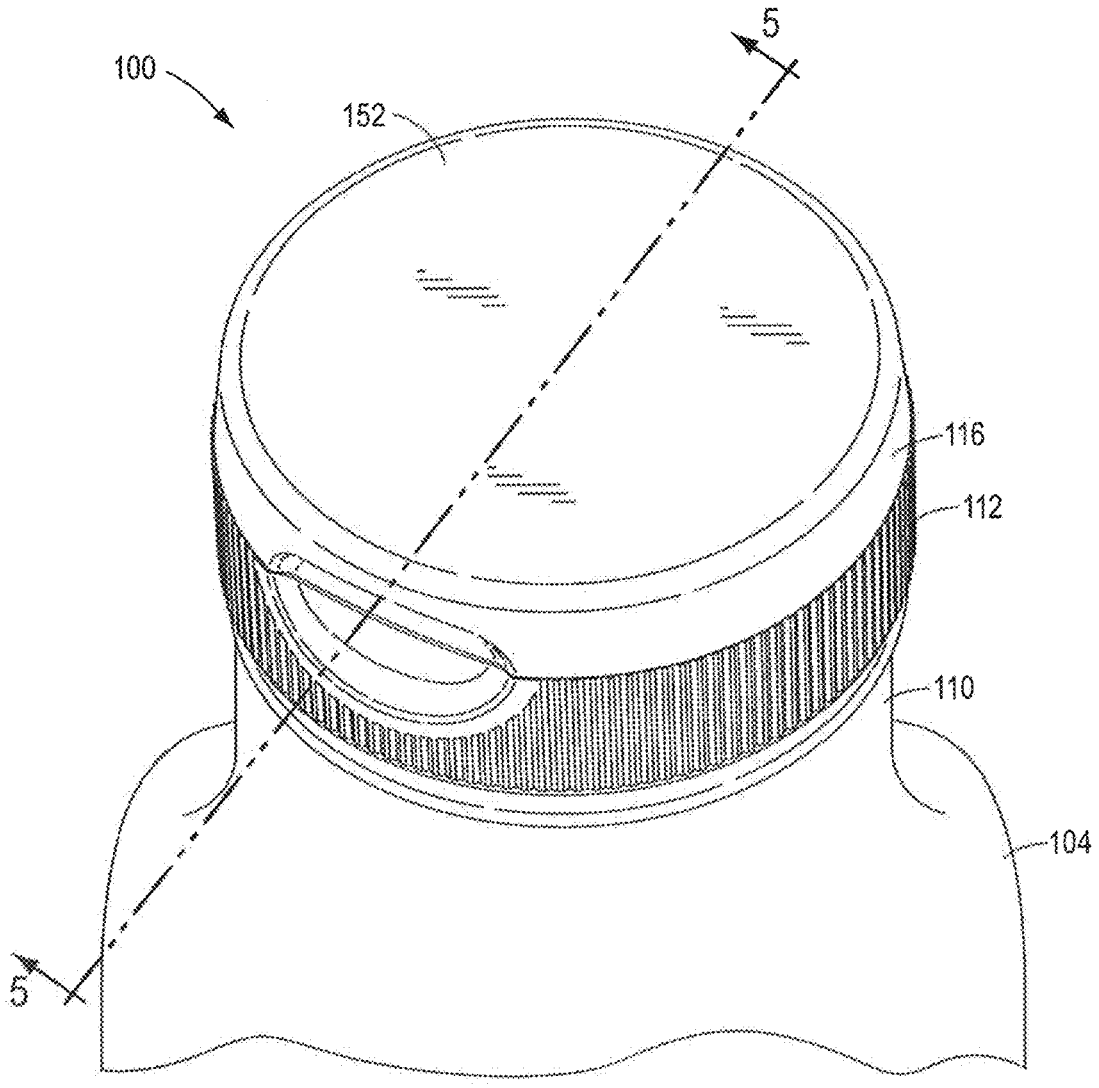
FIG. 1 is a fragmentary, perspective view taken from above of a first embodiment of a closure of the present invention shown with the lid in a closed position and installed on a container in which a product may be stored—the closure, container, and product therein together constituting a "package"
Figure 2:
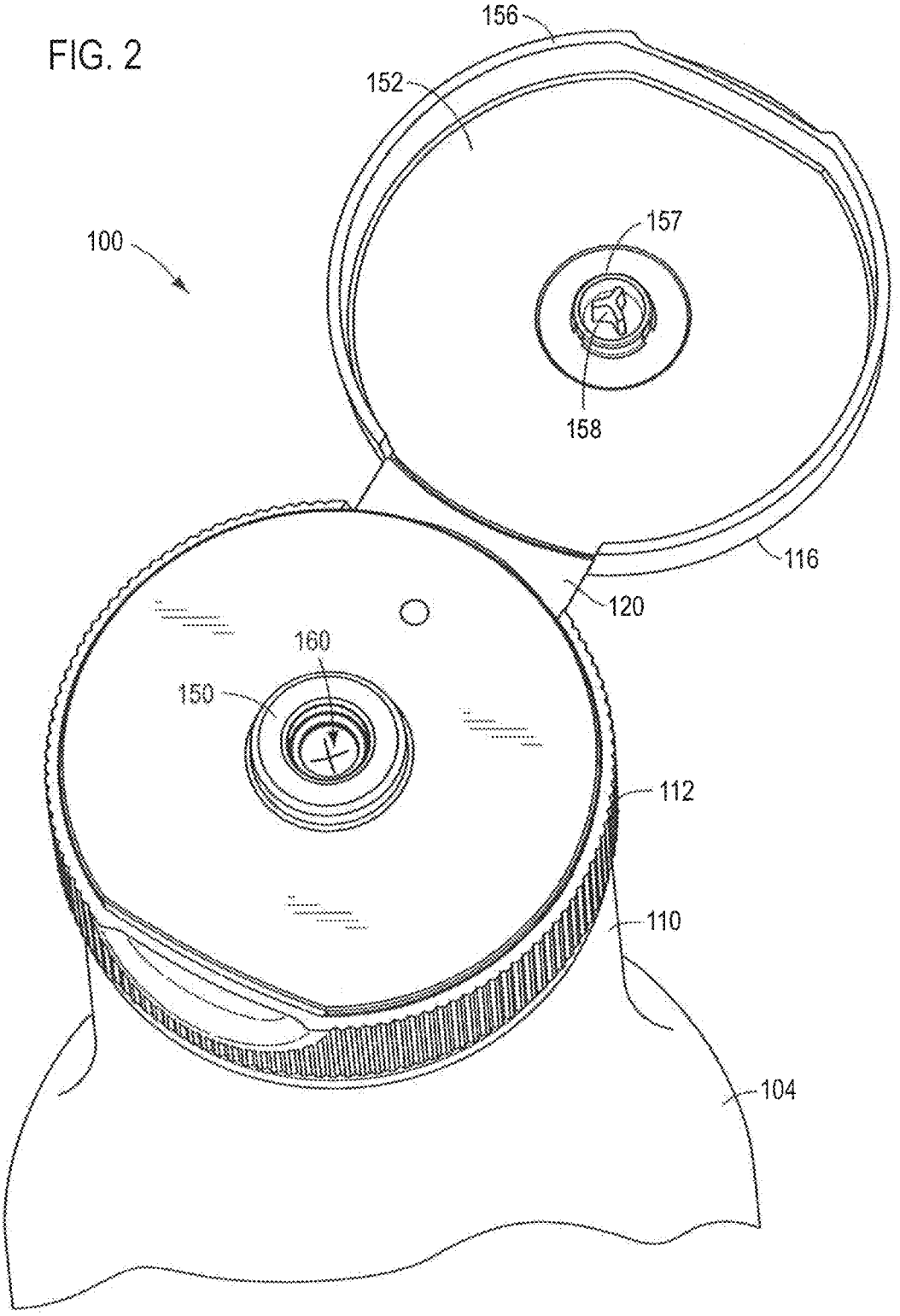
FIG. 2 is a fragmentary, perspective view taken from above of the package shown in FIG. 1, but in FIG. 2 the lid of the closure has been moved from a closed position to an open position allowing access to the container interior.

The closure 100 comprises a base 112 (i.e., a base peripheral wall or other peripheral structure) and a lid 116 (i.e., closing element, top, or cover) joined to the base 112 by a hinge 120 (FIG. 2). The closure base 112, lid 116, and hinge 120 can be readily molded together as a unitary structure in an open condition from a suitable thermoplastic material such as polyethylene, polypropylene or the like. Other materials may be employed instead.

In the embodiment illustrated in FIGS. 1-6, the closure 100 is initially molded as a completely separate article that is subsequently attached to the container 104 after the container 104 has been initially filled with a product. The closure base 112 has a depending, peripheral, outer skirt 124 (FIG. 4) for surrounding the container neck 110. The closure base 112 also includes a downwardly depending inner skirt 128 (FIG. 4) with a conventional, internal thread 132 (FIG. 4) for threading engagement with the external thread 136 on the neck 110 of the container 104 so as to secure the closure base 112 to the container 104. The thread 132 could be replaced by a conventional snap-fit bead (not illustrated) for engaging a mating bead (not illustrated) on the container neck 110 instead of the thread 136. Alternatively, the closure base 112 may be permanently attached to the container 104 by means of induction bonding, ultrasonic bonding, gluing, or the like, depending upon the materials employed for the container 104 and closure base 112.

Figure 4:
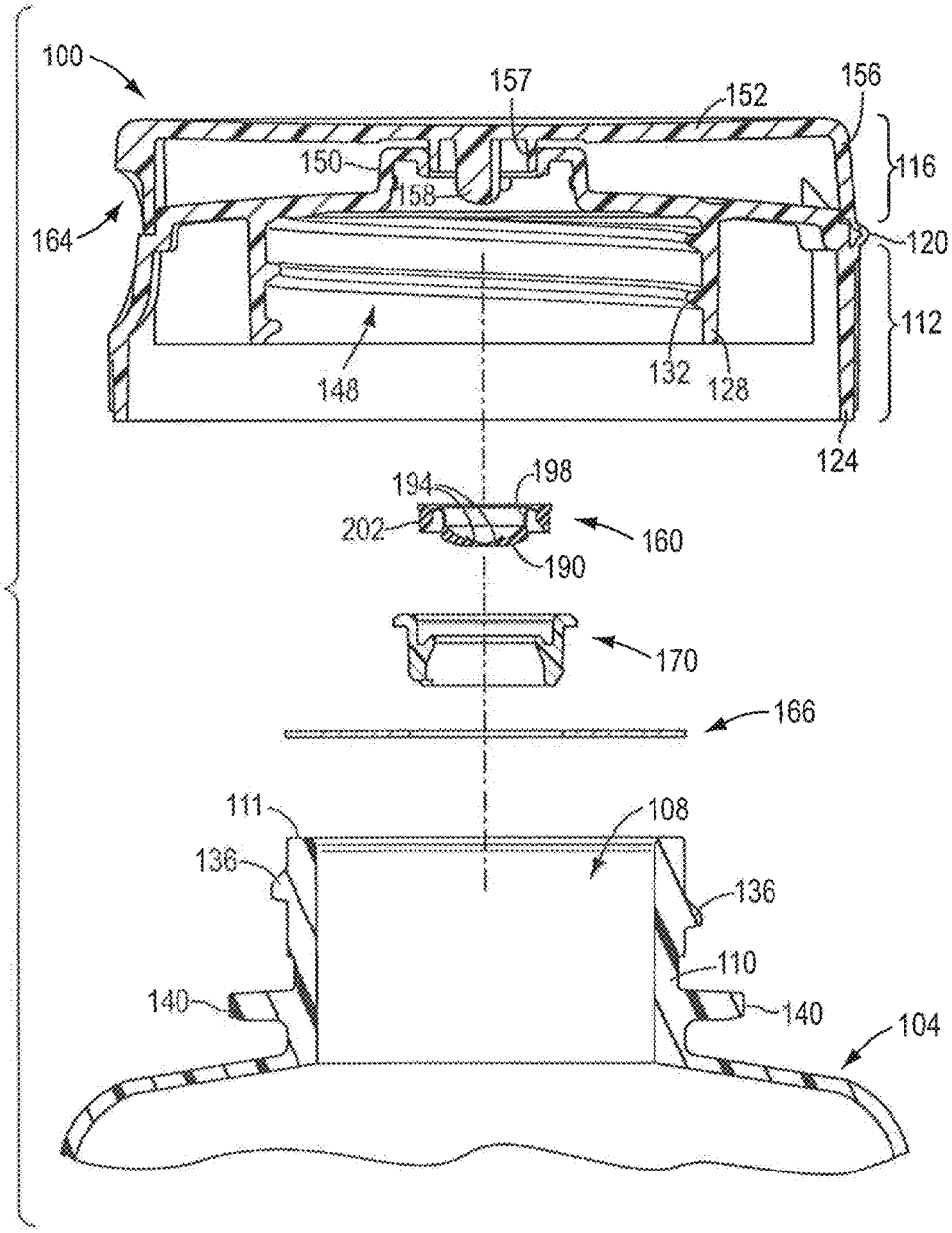
FIG. 4 is a fragmentary, exploded, cross-sectional view of the package taken along the plane 4-4 in FIG. 3.

The closure base 112 has an opening or access passage 148 (FIG. 4) that permits communication between the container interior and the exterior when the lid 116 is open. The access passage 148 accommodates the flow of product through the closure 100 from the interior of the container 104. The access passage 148 extends through a spout 150 (FIGS. 2 and 4) that extends outwardly from the top of the base 112 (FIG. 4). The access passage 148 is covered by the lid 116 when the lid is 116 is in a closed position.

Figure 6:
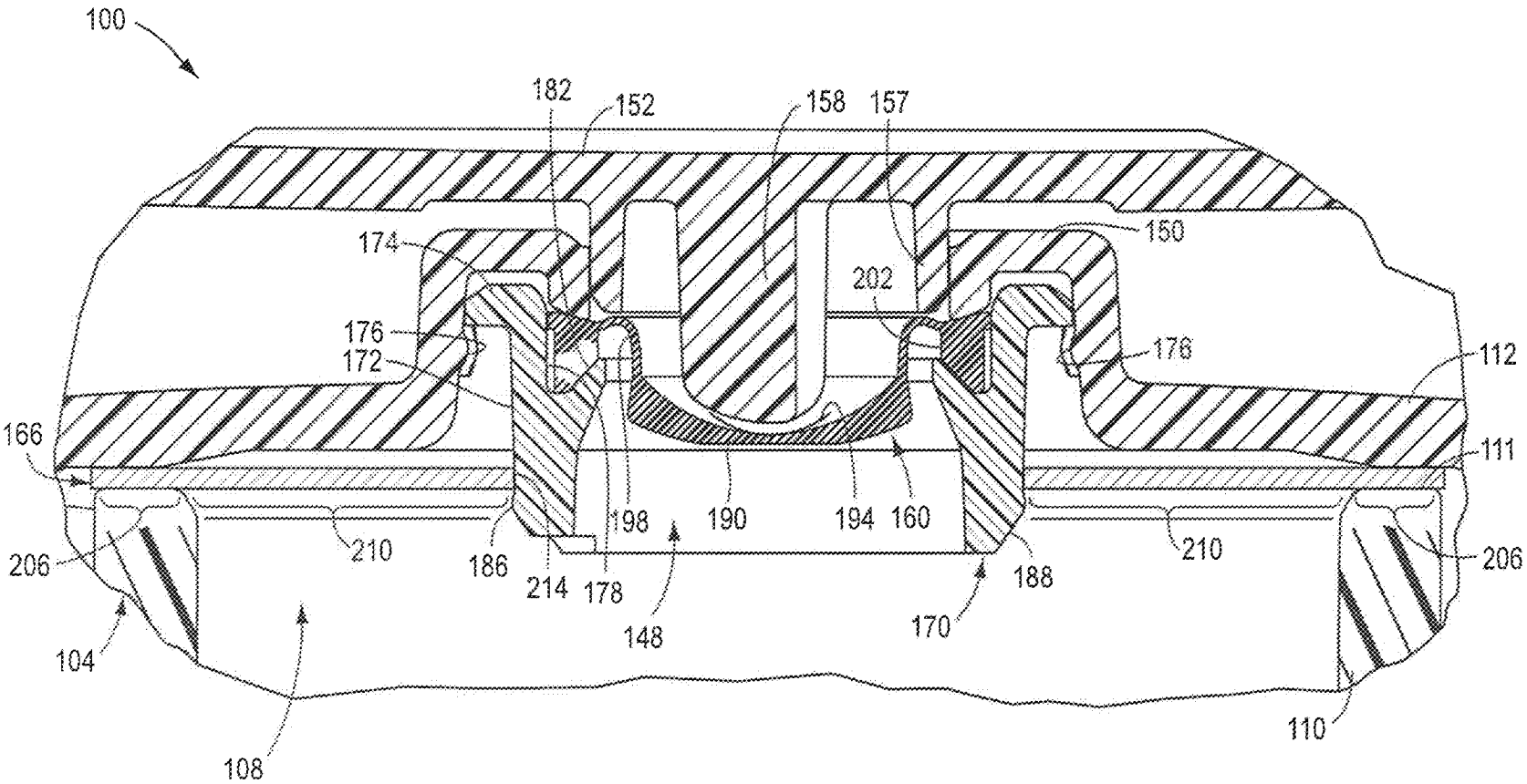
FIG. 6 is an enlarged, fragmentary, cross-sectional view of an interior portion of the package enclosed in the oval designated "FIG. 6" in FIG. 5.
Figure 7:
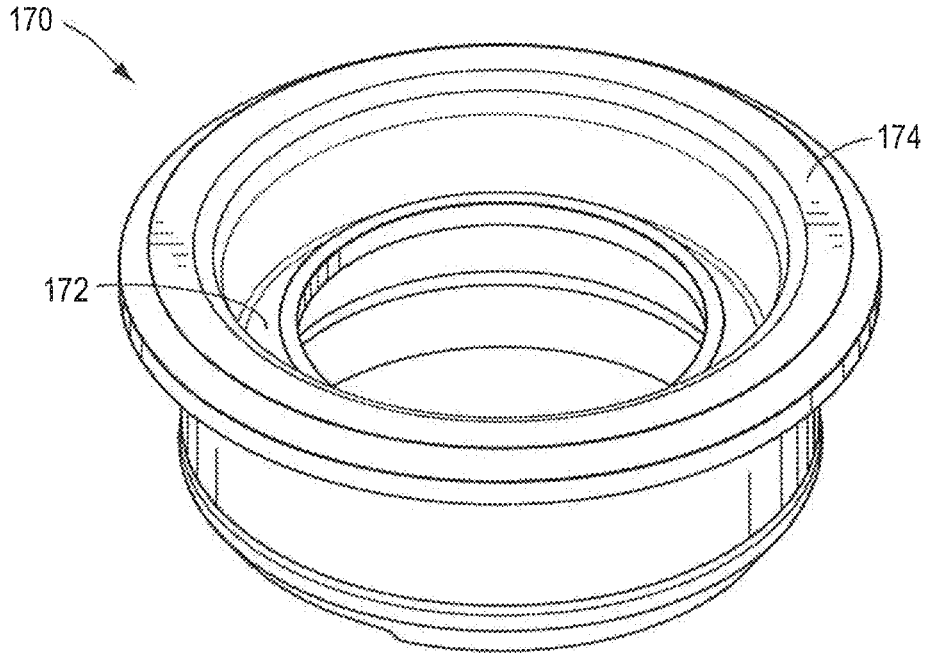
FIG. 7 is a perspective view taken from above of only the retainer of the closure shown in FIG. 3.
Figure 8:
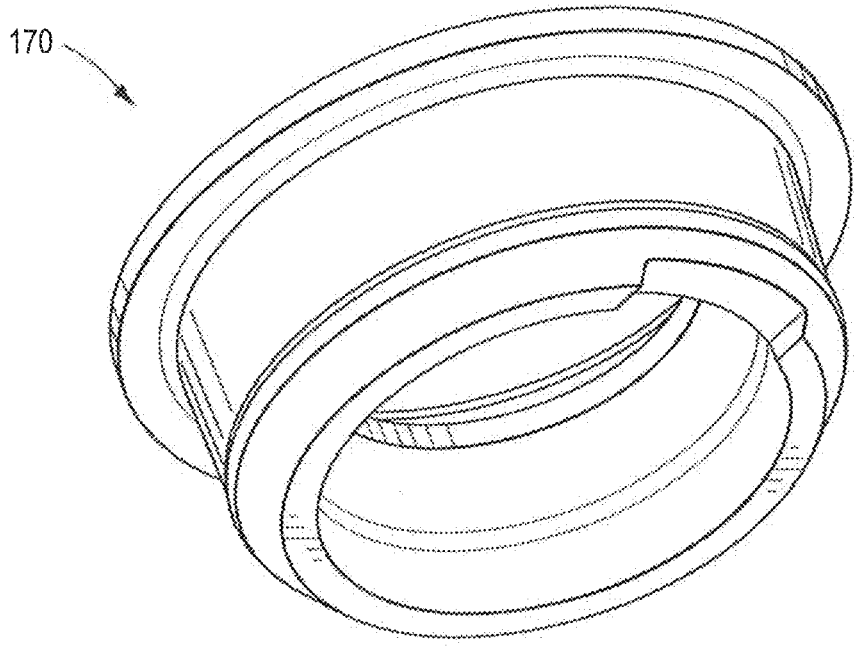
FIG. 8 is a perspective view taken from below of the retainer shown in FIG. 7.
Figure 9:
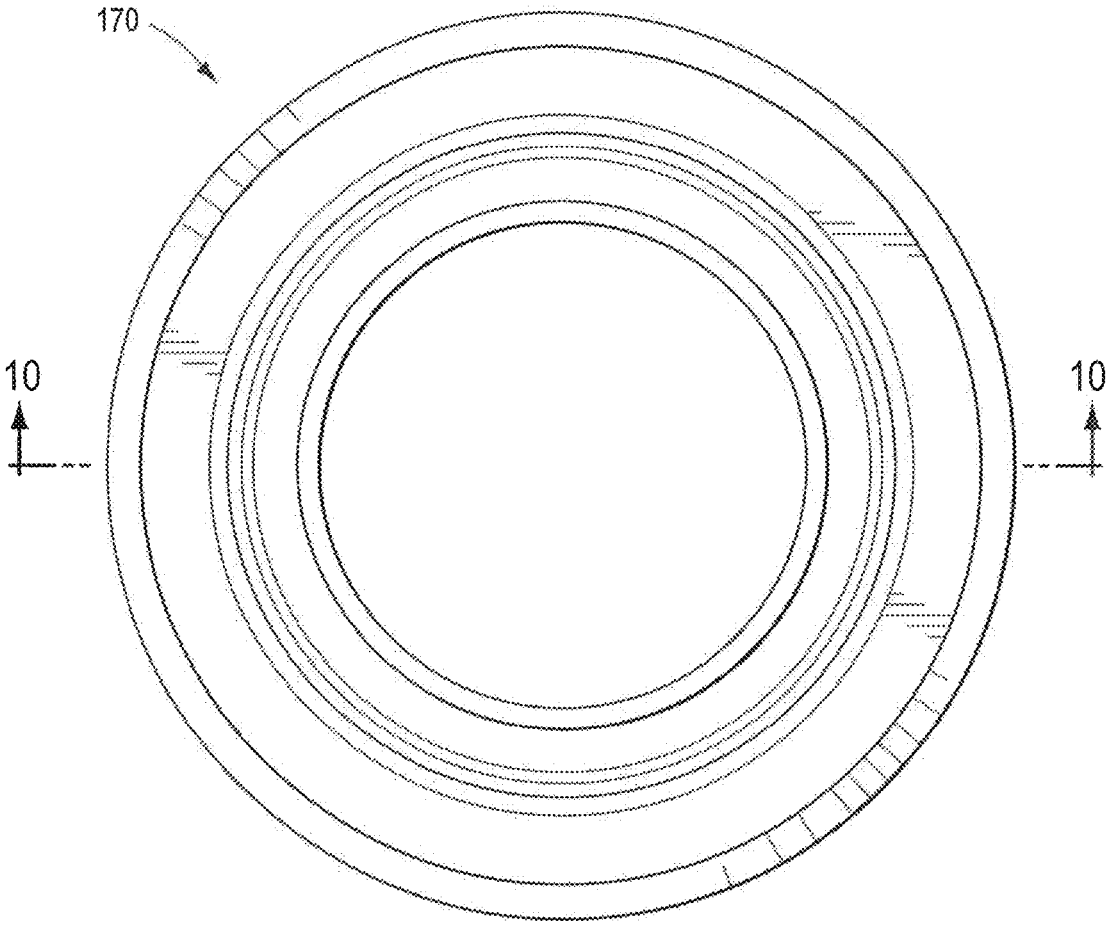
FIG. 9 is a top plan view of the retainer shown in FIG. 7.

The lid 116 includes a top deck or cover 152 portion (FIG. 2) substantially surrounded by an outer peripheral flange 156 (FIG. 2). An inner plug seal flange 157 projects from the underside of the cover portion 152 to sealingly engage the inside of the spout 150 when the lid 116 is closed (FIG. 4). A valve abutment or spud 158 projects from the underside of the lid cover portion 152 to inhibit opening of a valve 160 (discussed in detail herein below) when the lid 116 is closed (FIG. 6). The spud 158 prevents the valve 160 from opening under the closed lid 116 if the container 104 is pressurized due to impacts, processing, or changes in temperature or atmospheric pressure.

The hinge 120, which connects the lid 116 to the base 112 of the closure 100, is molded unitarily together with the lid 116 and the base 112 near the top of the base peripheral skirt 124 (FIG. 4) so as to accommodate movement of the lid 116 between the open position exposing the access passage 148, and the closed position occluding the access passage 148.

With reference to FIG. 2, the hinge 120 may be of any suitable conventional or special design. For example, the hinge 120 illustrated in the Figures may be of a conventional snap-action type such as described in the U.S. Pat. Nos. 5,356,017 or 5,642,824, the details of which form no part of the present invention. The hinge 120 could also be a non-snap-action type, including a strap or tether. Preferably, the hinge 120 is molded unitarily with the base 112 and lid 116. However, in another embodiment (not illustrated), the hinge 120 may be omitted entirely, and the lid 116 can be completely separate, and completely removable, from the closure body. In such a case, the lid 116 could be a screw-on or snap-on type, for example. In some applications, the lid 116 could be omitted altogether.

A front portion of the closure lid 116 has a recess or lid lift 164 for engagement by a consumer or user of the package. To open the lid 116, the user pulls outwardly and upwardly with a thumb or finger on the bottom of the lid lift 164 to disengage the inner plug seal flange 157 from access passage 148 in the spout 150 of the base 112. Other conventional or special designs could be used instead to retain the lid 116 on the base 112, such as a latch (not illustrated).

The closure 100 includes a seal or liner 166 (FIGS. 3 and 4) to provide an enhanced leak-tight seal between the closure base 112 and the container upper end 111 as discussed in detail hereinafter.

With reference to FIGS. 4-6, the closure 100 has a snap ring or retainer 170 for engaging the liner 166 and for retaining the valve 160 in the closure base 112. The retainer 170 has an exterior surface 172 (FIG. 6) with a radially outwardly extending flange 174 (FIG. 6) for engaging a snap bead 176 in the closure base 112 to retain the retainer 170 in the closure base 112.

The retainer 170 further has an interior recess surface 178 (FIG. 10) and a radially inwardly extending projection or valve seat 182. As can be seen in FIG. 6, the valve seat 182 is generally frustoconical for confronting a peripheral mounting flange portion of the valve 160 when the valve 160 is installed in the closure 100 between the retainer 170 and the closure base 112, as will be discussed in detail herein.

Figure 10:
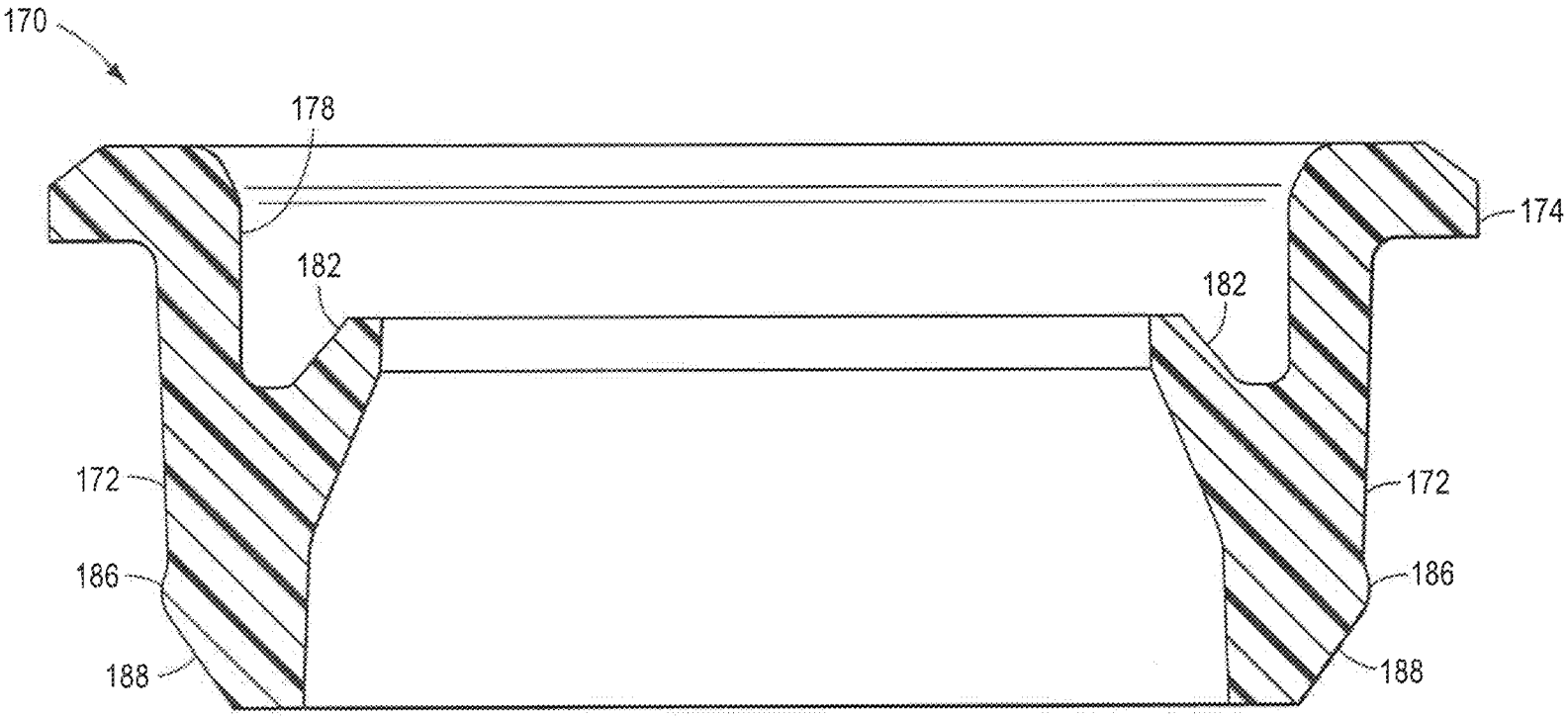
FIG. 10 is an enlarged, cross-sectional view of the retainer taken along the plane 10-10 in FIG. 9.
Figure 11:
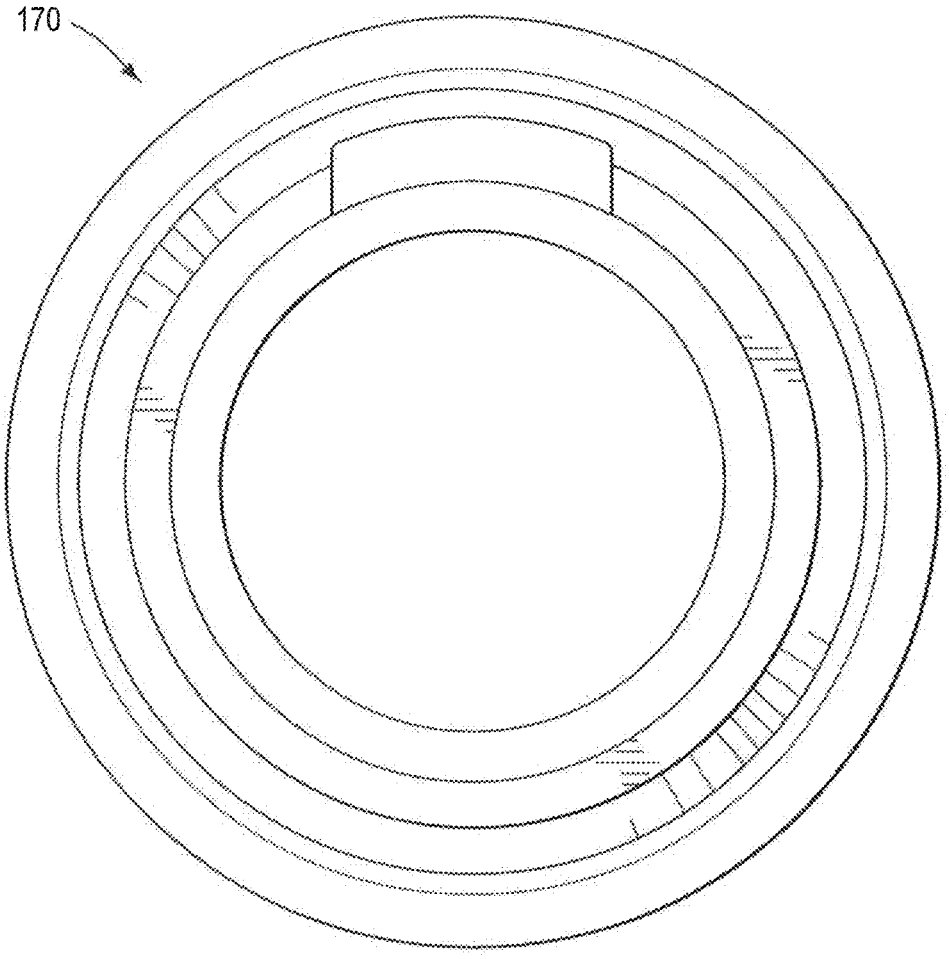
FIG. 11 is a bottom plan view of the retainer shown in FIG. 7.
Figure 12:
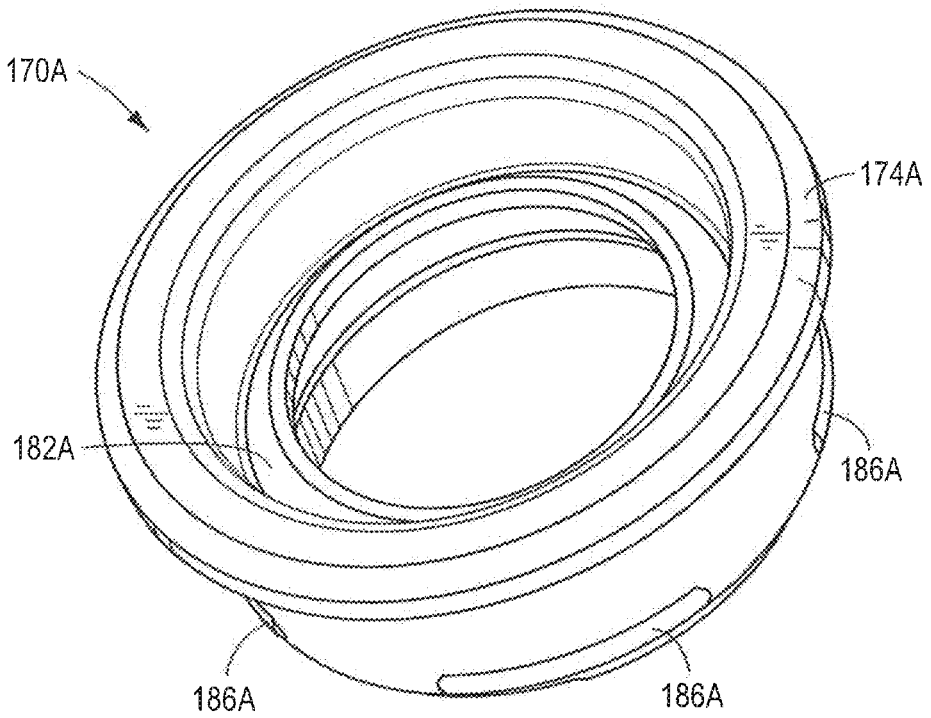
FIG. 12 is an perspective view taken from above of a second embodiment of a retainer of a closure of the present invention.
Figure 13:
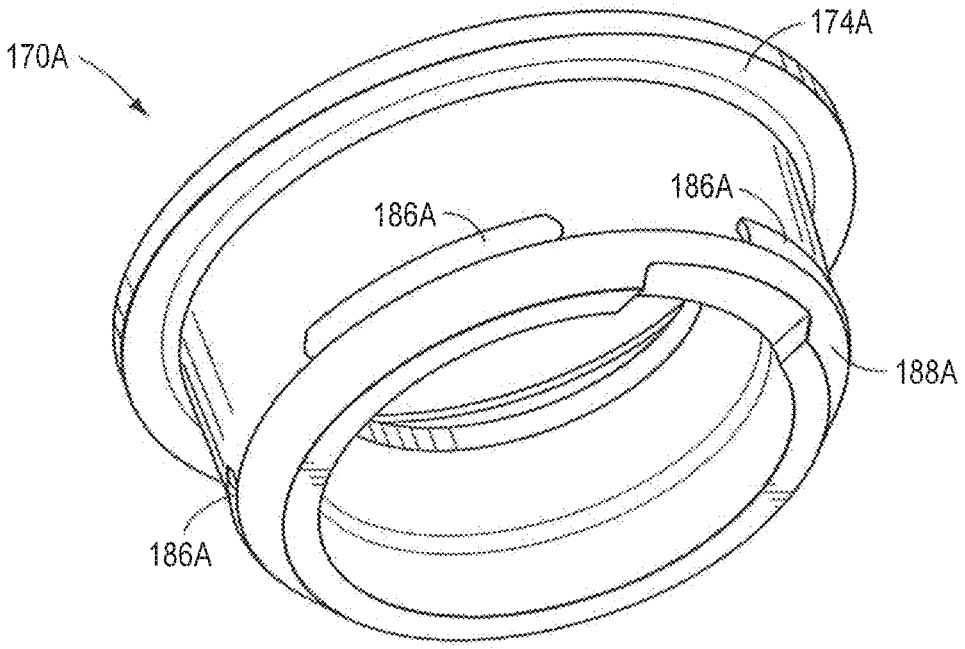
FIG. 13 is a perspective view taken from below of the retainer shown in FIG. 12.
Figure 14:
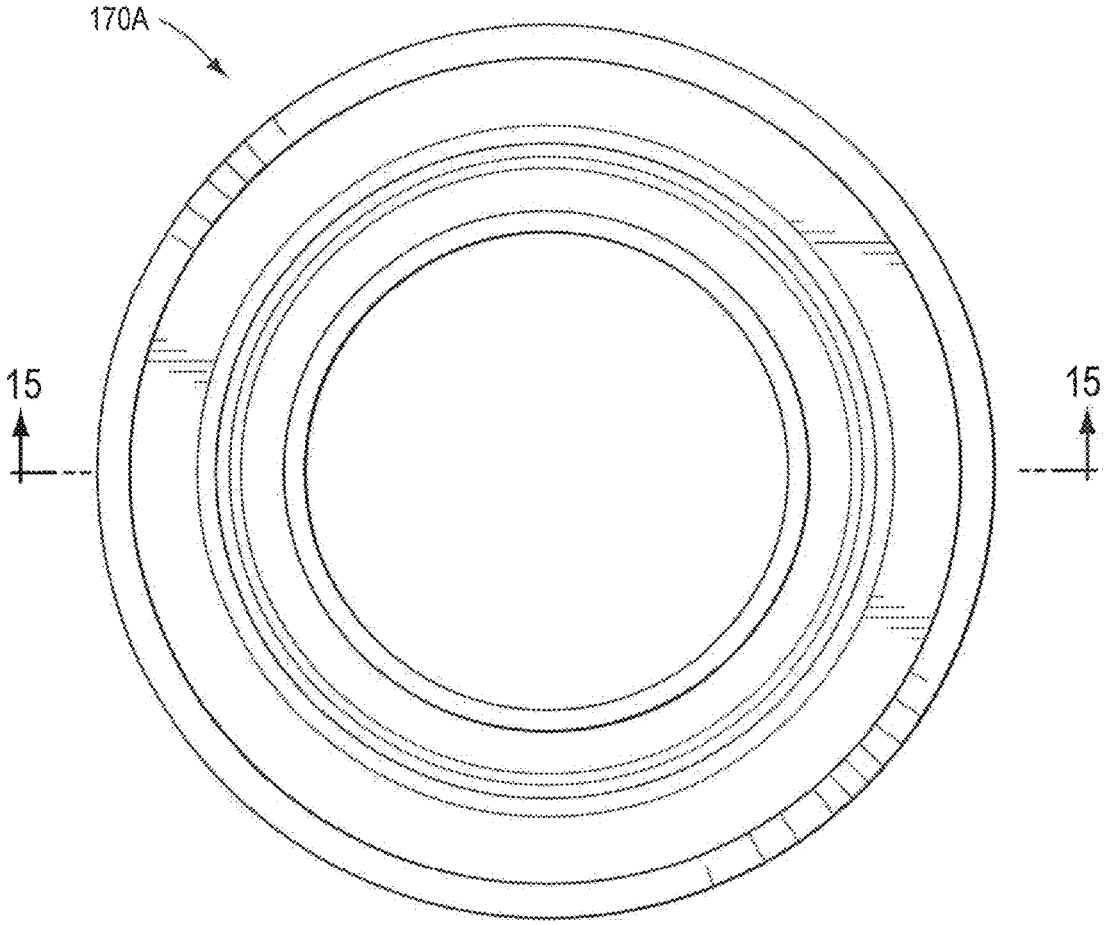
FIG. 14 is a top plan view of the retainer shown in FIG. 12.

As can be seen in FIGS. 6 and 10, the retainer 170 has a projection or liner abutment 186 extending radially outwardly from the exterior surface 172 of the retainer 170. After the closure base 112, valve 160, and retainer 170 have been initially assembled by the manufacturer, the manufacturer (or packager) can slide the liner 166 up onto the bottom end of the retainer 170 past the liner abutment 186. At the bottom of the retainer 170, a tapered surface 188 (FIGS. 6 and 10) extends radially inwardly to accommodate installation of the liner 166 on the retainer 170, as will also be discussed in detail herein. After the liner 166 has been installed on the retainer 170, the liner abutment 186 retains the liner 166 on the retainer 170 during further processing (e.g., shipping, handling, and installation of the closure on the container). The abutment 186 and adjacent portion of the retainer 170 minimize contact of an inner edge portion of the liner 166 with the contents of the container 104, as will be discussed in detail herein.

While the retainer 170 is illustrated as having a generally hollow, cylindrical shape with an axially outward open end (i.e., top end) and an axially inward open end (i.e., bottom end), it will be appreciated that the retainer 170 may have a variety of shapes, such as polygonal or an irregularly shaped hollow body, depending on a number of design choices, such as the size and shape of the container 104, the closure 100, the liner 166, and/or other optional functional or aesthetic features of the package components.

As can best be seen in FIGS. 5 and 6, the illustrated preferred form of the valve 160 is a flexible, resilient, and self-sealing valve of a type that is commercially available and is that substantially disclosed in the U.S. Pat. No. 5,676,289 with reference to the valve 46 identified in the U.S. Pat. No. 5,676,289. The operation of such a type of valve is further described with reference to the similar valve that is designated by reference number 3d in the U.S. Pat. No. 5,409,144. The descriptions of those two patents are incorporated herein by reference thereto to the extent pertinent and to the extent not inconsistent herewith. Such a valve, when subjected to a pressure differential acting across it in the closed condition, changes configuration between: (1) the closed condition (i.e., an as-molded, closed, unpressurized condition); and (2) an open, pressurized condition (not illustrated) wherein a substance (e.g., a product to be dispensed) may move through the valve 160. The valve 160 is preferably molded as a unitary structure from a material which is flexible, elastic, and resilient, such as silicone rubber, or other elastomers.

Figure 3:
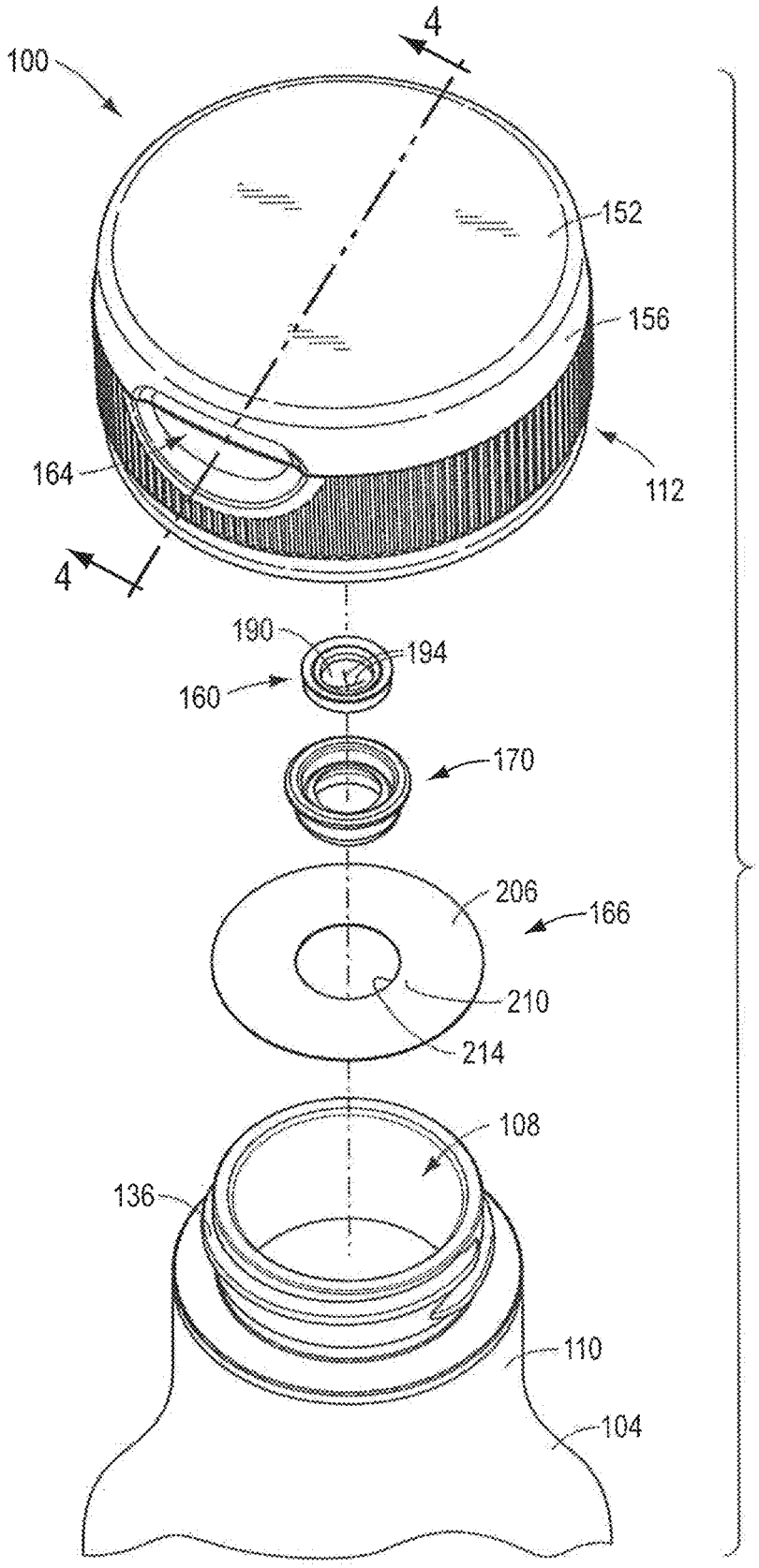
FIG. 3 is a fragmentary, perspective, exploded view of the package shown in FIG. 1.

The valve 160 includes a flexible, central portion or head 190. When the valve 160 is in an as-molded, closed, and unpressurized condition, the head 190 has a generally concave configuration when viewed from the exterior of the top of the closure when the lid 116 is open (FIG. 2). As can be seen in FIG. 3, the valve head 190 has two intersecting, perpendicular, dispensing slits 194 that define four petals or flaps in the valve head 190. The flaps open outwardly from the intersection of the slits 194 in response to an increasing pressure differential across the valve 160, as is generally described in U.S. Pat. No. 5,409,144. The slits 194 could be molded with the valve head 190, or they may be cut into the valve head 190 in a secondary manufacturing process. It will be understood that the valve 160 may have one or more dispensing orifices defined by structures other than slits 194, such as apertures or slits of different shapes, sizes, numbers, or configurations depending on the nature of the product within the container 104 and uses of the product.

Referring to FIG. 6, the valve 160 has a peripheral skirt or sleeve 198 connected to the valve head 190. At the radially outward end of the sleeve 198, the valve 160 has a peripheral flange or mounting portion 202 for being engaged between: (1) the valve seat 182 of the retainer 170; and (2) the underside of the closure base 112. The mounting portion 202 of the valve 160 has a generally dove-tailed shaped, transverse cross-section. The valve mounting portion 202 is preferably compressed or clamped between the valve seat 182 of the retainer 170 and the underside of the closure base 112 within the spout 150.

Referring to FIGS. 5 and 6, the membrane or liner 166 is disposed across a lower portion of the closure base 112 and across the container open end 108 to prevent leakage of the product between the closure base 112 and the container neck 110. The closure 100 of the present invention is especially suitable for use with a liner 166 that is made from a foil liner material that includes at least one layer of metallic foil, typically aluminum, and one or more covering layers of a thermoplastic polymer or polymers that can be heat sealed to the container upper end 111 (and preferably also to the underside of the closure base) by well-known, conventional heating methods, such as induction heating, which causes the metal layer to heat up and conduct the heat into the adjacent covering layer or layers of the thermoplastic polymer.

Such a foil liner material may be of any suitable special or conventional type. One conventional liner material is a commercially available foil liner material sold under the trade designation "LAMINATE 150MDPE/0.001CPP" by Coflex Packaging having an office at 1970 John-Yule Street, Chambly, Quebec, J3L 6W3, Canada (Website: www.deluxepaper.com). This liner material consists of a layer of 25 micron thick aluminum foil that is (1) bonded with adhesive to a top layer of 25 micron thick cast polypropylene, and (2) bonded with adhesive to a bottom layer of 38 micron thick medium density polyethylene. Including the adhesive, the liner material has a total thickness of about 94 microns and has a total basis weight of about 132 grams per square meter. The particular composition of the liner material that is used for the liner 166 forms no part of the broad aspects of the present invention.

If the above-described metal foil liner material is used for the liner 166, then the liner 166 can be attached by thermal bonding (i.e., heat healing) to portions of the downwardly facing, interior surface of the closure spout 150. The liner 166 can also preferably be attached by heat sealing to the top of the container 104. This form of the liner 166 can be readily attached by conventional induction heat sealing of the liner's polypropylene top surface to the closure 100 that is molded from polypropylene, and by conventional induction heat sealing of the liner's bottom polyethylene surface to a polyethylene container 104.

Although the closure 100 of the present invention is especially suitable for use with the liner 166 that has a metal foil layer which is exposed at the cut, internal edge 214, the closure 100 may also be advantageously used with liners that do not include a metal foil layer.

Still referring to FIG. 6, the illustrated preferred shape of the liner 166 is generally annular or ring-shaped, and the liner 166 has an outer peripheral portion 206 for being engaged by and between the closure base 112 and the container upper end 111, and for being heat sealed to the closure base 112 and container upper end 111. The liner 166 has an internal portion 210 (FIG. 6) that extends radially inwardly from the outer peripheral portion 206 for engaging or abutting the retainer 170 to create a frictional seal. As can be seen in FIG. 6, the internal portion 210 is cantilevered radially inward from the container upper end 111 when the liner has been installed between the closure base 112 and the container 104, and the internal portion 210 has a greater radial length than the peripheral portion 206. Preferably, the internal portion 210 has a radial length that is at least three times greater than the radial length of the sealed or retained peripheral portion 206.

Using conventional techniques, the liner 166 can be stamped or die cut from a sheet of the liner material, and therefore such a stamped or die cut liner 166 has a cut, outer edge (i.e., circumferential, peripheral edge), and a cut internal edge 214 (i.e., an inner edge or interior edge) which expose the metal layer.

During assembly of the closure 100, after valve 160 and retainer 170 are mounted to the underside of the closure base 112, the liner 166 is installed on the retainer 170 by pushing the liner 166 onto the lower end of the retainer 170 and then upwardly past, and above, the liner abutment 186. To accommodate installation of the liner 166 on the retainer 170 as the liner internal portion 210 initially engages the retainer tapered surface 188 (FIG. 10), the liner 166 expands, stretches, or otherwise deflects as the liner 166 moves along the retainer 170 and past (i.e., above) the liner abutment 186. The cut, internal edge 214 remains engaged with the retainer exterior surface 172 after the liner 166 has been installed on the retainer 170. Once the liner 166 is in place, the liner abutment 186 may inhibit the internal edge 214 from moving (e.g., deflecting) axially inwardly (i.e., downwardly) past (i.e., below) the abutment 186 as viewed in FIG. 6.

Although the liner 166 is illustrated as having a generally ring-like shape, it will be appreciated that the liner 166 may have a variety of shapes that have an open interior or aperture defined by an internal edge 214 for accommodating particular shapes of a container and retainer (such as the container 104 and the retainer 170).

The inventors of the present invention have found that when some prior art closures with liners having a metal component (e.g., aluminum) are installed on a container that contains an acidic product (e.g., ketchup), an undesirable change in the acidic product (e.g., discoloration, taste changes, etc.) may result when the exposed metallic liner edge contacts and interacts with the acidic product. When such a liner metallic internal edge is located within a package at a location that is near or proximate a flow path of the acidic product, such an undesirable change may occur in the acidic product, and the user is more likely to notice the undesirable change in the acidic product.

According to one aspect of the present invention, the location of the liner abutment 186 near the flow path of the acidic product prevents, or at least minimizes or inhibits, movement of the liner cut internal edge 214 into the acidic product. In a dispensing condition, which will be discussed in greater detail herein, the acidic product flows from the interior of the container 104, through the hollow retainer 170, through the open valve 160, and out of the closure 100. The prevention, or minimization, of movement of the internal edge 214 into or toward the product flow path may thus eliminate, or at least reduce, contact between the cut, metallic internal edge 214 and the acidic product. Thus, undesirable changes in the acidic product can be prevented or at least minimized during use of the package.

In a typical method of assembly of the closure 100 with a container 104 to create a package as illustrated in FIG. 6, the valve peripheral portion 202 is inserted either in the seat 182 of the retainer 170, or into the recessed region beneath the base spout 150 of the closure 100. Then the retainer 170 is snapped into the closure base 112 so that the retainer flange 174 is located axially past (i.e., above) the closure base snap bead 176 so as to compress the valve peripheral portion 202 between the retainer valve seat 182 and the underside of the closure base spout 150. Next, the liner 166 is pushed onto the bottom end of the retainer 180 so that the internal edge 214 of the liner 166 moves axially along and above the retainer tapered surface 188 (with the liner 166 stretching as necessary as the liner 166 moves axially past the liner abutment 186). The closure 100 is then threadingly installed on the container 104 to clamp the liner peripheral portion on 206 against the container upper end 111. Finally, a heat seal is created by heat welding the liner peripheral portion 206 to the container neck 111 and also preferably to the underside of the closure base. The container 104 may be filled prior to, or after, the installation of the closure 100 onto the container 104.

Typically, the closure manufacturer makes and assembles the closure components (the base 112 (and lid 116, if any), valve 160, retainer 170, and liner 166), and then ships the closure 100 as a complete assembly to the bottler for installation on a filled container.

Alternatively, depending on the manufacturing capability of the bottler, some of the steps of assembling the closure components could be performed by the bottler instead of closure manufacturer. For example, the closure base 112 (and lid 116, if any), valve 160, retainer 170, and liner 166 may be shipped by the closure manufacturer to a bottler as separate, unassembled components, and then the bottler can assemble the closure components and subsequently install the assembled closure on the container 104.

A method of dispensing product from a package (which comprises the closure 100 assembled to a container 104 containing a product) will next be described. A user typically first grasps the package and applies a force to the closure lid lift 164 with a thumb or finger to rotate the closure lid 116 from a closed position to an open position exposing the base spout 150. The lid 116 must be rotated sufficiently away from the valve 160 such that the spud 158 will not interfere with the movement of the valve 160 and flow of the product during dispensing of the product. The user then typically inverts the package and squeezes, or otherwise deflects, the walls of the container 104 inwardly to pressurize the interior of the container 104 and create a pressure differential across the valve 160 (i.e., the difference between the pressure on the valve's interior surface (facing the interior of the container 104) and the pressure on the valve exterior surface (facing the ambient, external environment). The greater pressure on the interior surface of the valve causes the valve sleeve 198 to move axially outwardly to carry the valve head 190 axially outwardly toward the open valve configuration where the petals, defined between the slits 194, open outwardly to dispense the product. During the dispensing of the product from the valve 160, the product flow path from the container interior through the retainer 170 substantially avoids the internal edge 214 of the liner 166 owing to engagement of the internal edge 214 with the retainer outer surface 172 and/or the liner abutment 186. When the user releases the squeezing force on the container 104, the pressure in the container interior will equalize with that of the ambient environment, and the resilient, flexible valve 160 will return to its as-molded, unpressurized closed condition.

It will be appreciated that the container 104 need not have flexible walls, and that other means for pressurizing the container interior may be employed, such as through hydraulic force, gas injection, or mechanical force such as would be the case if the container 104 were part of a dispensing machine or system.

A retainer 170A for a second embodiment of a closure according to the present invention is illustrated in FIGS. 12-15, and the retainer 170A functions analogously to the retainer 170 discussed above with reference to FIGS. 1-11. The numbered features of the second embodiment illustrated in FIGS. 12-15 are designated generally with the suffix letter "A" and are analogous to features of the first embodiment that share the same number of the retainer 170.

Figure 15:
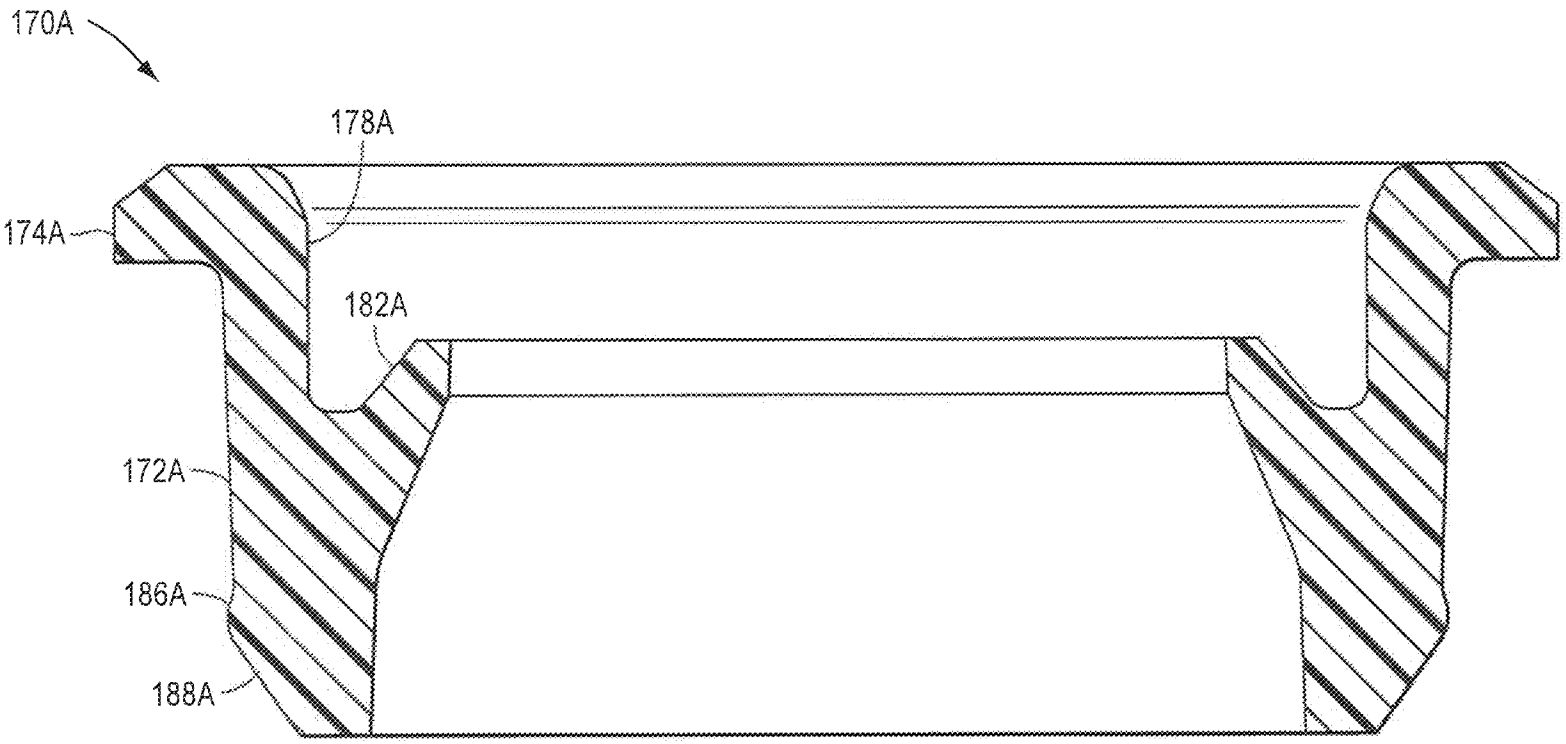
FIG. 15 is an enlarged, cross-sectional view of the retainer taken along the plane 15-15 in FIG. 14.
Figure 16:
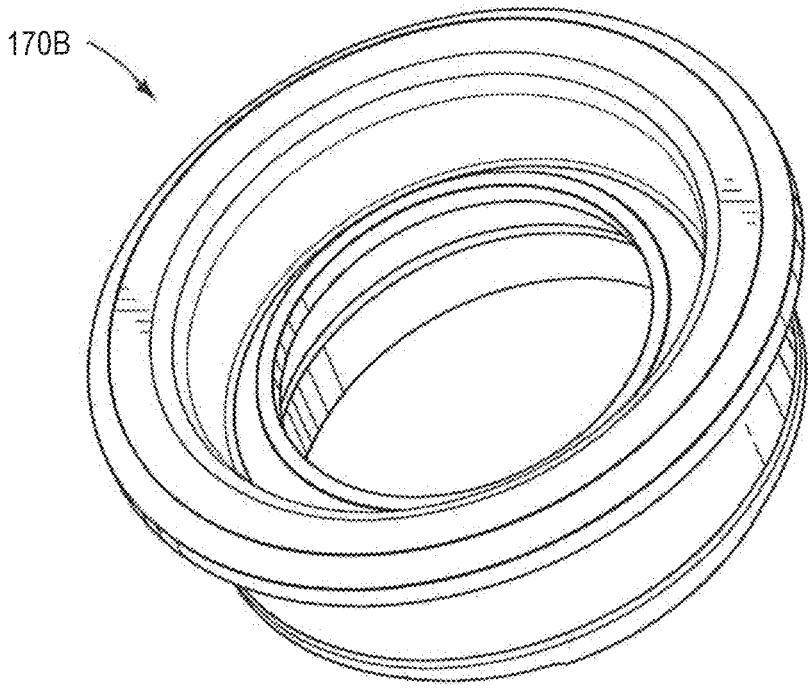
FIG. 16 is an perspective view taken from above of a third embodiment of a retainer of a closure of the present invention.
Figure 17:
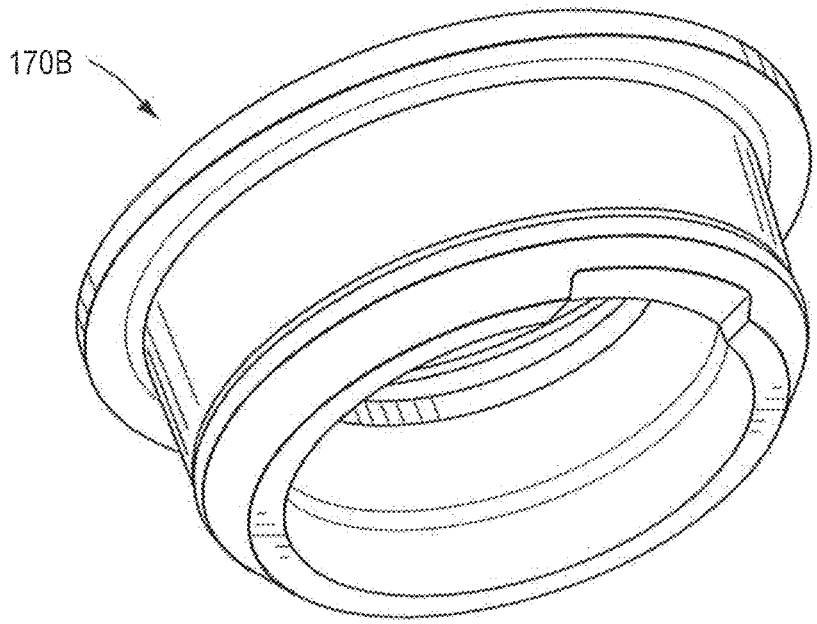
FIG. 17 is a perspective view taken from below of the retainer shown in FIG. 16.
Figure 18:
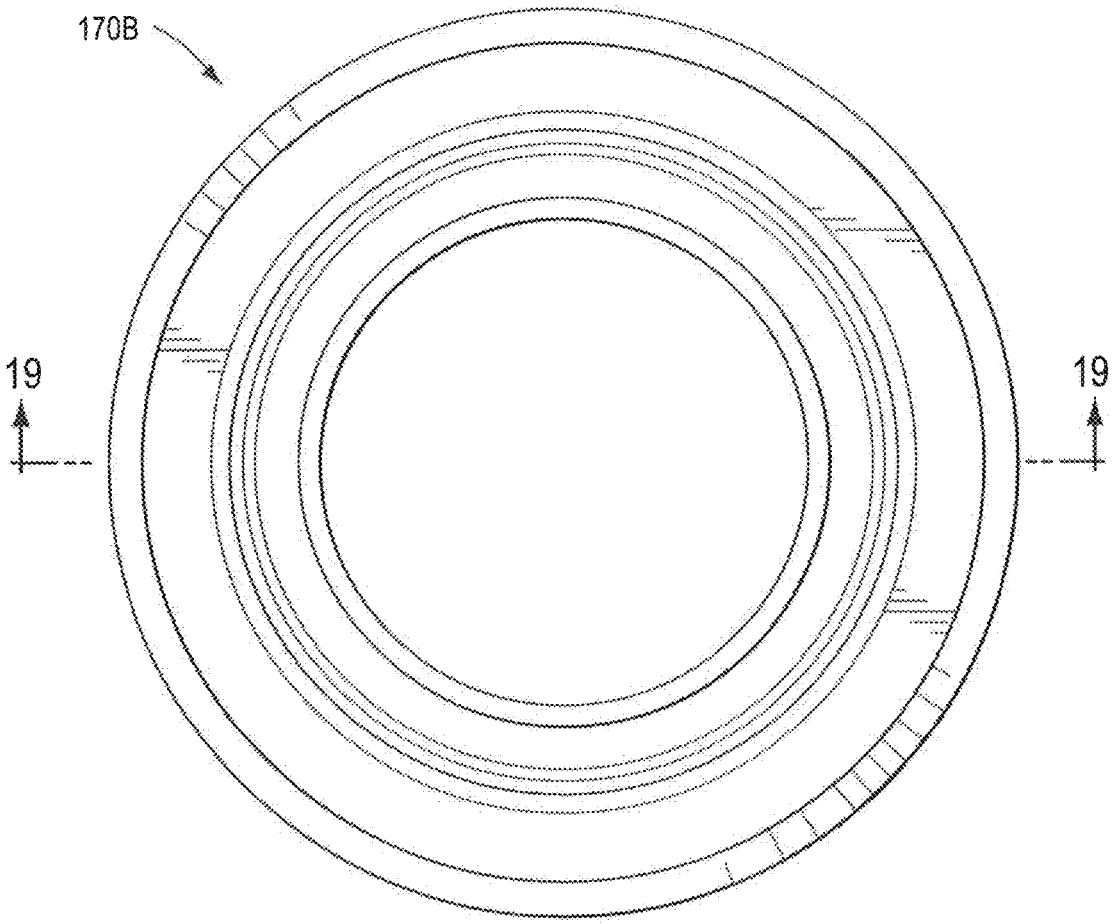
FIG. 18 is a top plan view of the retainer shown in FIG. 16.
Figure 19:
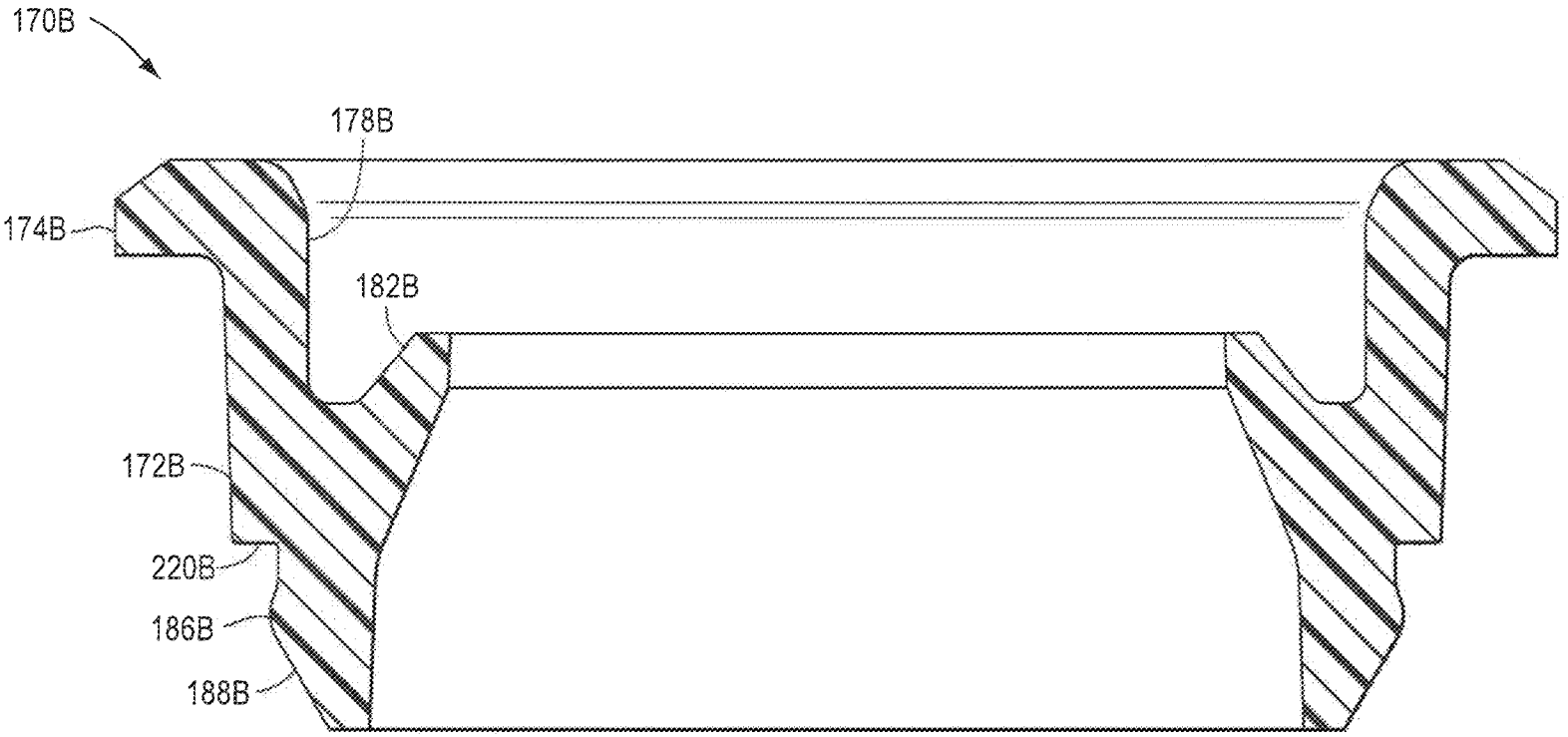
FIG. 19 is an enlarged, cross-sectional view of the retainer taken along the plane 19-19 in FIG. 18

With reference to FIG. 15, some of the elements of the first embodiment of the retainer 170 that are present in the second embodiment of the retainer 170A include an exterior surface 172A, a flange 174A, an interior recess surface 178A, a valve seat 182A, a liner abutment or projection 186A, and a tapered surface 188A. However, the retainer 170A differs from the retainer 170 in that the retainer 170A has four, circumferentially space-apart liner abutments 186A for inhibiting axially inward movement of a cut internal edge of a liner (not shown in FIGS. 12-15). The plurality of liner abutments 186A of the retainer 170A function in substantially the same way as does the single, fully annular liner abutment 186 of the retainer 170. However, the retainer 170A utilizes or requires less material than does the retainer 170. It will be appreciated that the retainer 170A may have any number of multiple abutments 186A, and the abutments 186A may have a shape that varies from the generally rounded projections or beads illustrated in FIGS. 12-15 (e.g., such as polygonal, or irregularly curved projections).

A retainer 170B for a third embodiment of a closure according to the present invention is illustrated in FIGS. 16-19, and the retainer 170B functions analogously to the retainer 170 discussed above with reference to FIGS. 1-11. The numbered features of the third embodiment illustrated in FIGS. 16-19 are designated generally with the suffix letter "B" and are analogous to features of the first embodiment that share the same number of the retainer 170.

With reference to FIG. 15, some of the elements of the first embodiment of the retainer 170 that are present in the second embodiment of the retainer 170B include an exterior surface 172B, a flange 174B, an interior recess surface 178B, a valve seat 182B, a liner abutment or projection 186B, and a tapered surface 188B. However, the retainer 170B differs from the retainer 170 in that the retainer 170B also has a shelf or annular shoulder 220B for minimizing or inhibiting axially outward movement of a cut internal edge of a liner (not shown in FIGS. 16-19). The annular shoulder 220B, together with the annular abutment 186B of the retainer 170B, serve to locate or otherwise retain the liner on the retainer 170B within a limited, small, range of axial positions at the bottom of the retainer 170B. The limited range of the axial position of the liner allows for more controlled assembly of the liner with the retainer 170B. It will be appreciated that the retainer 170B may have a number of separate, circumferentially disposed shoulder segments instead of the single continuous annular shoulder 220B illustrated. It will also be appreciated that the annular shoulder 220B may have a shape that varies from the generally right-angled shoulder illustrated in FIGS. 16-19 (e.g., a shoulder having a different angle or a curve).

The present invention can be summarized in the following statements or aspects numbered 1-14:

1. A closure for a container having an opening to the interior of the container wherein contents may be stored, said closure comprising:

(A) a base having open ends defining an access passage extending between said open ends, said base accommodating installation at the opening of the container interior to permit communication between the container interior and the exterior of the container;

(B) a liner for being disposed between said closure base and the opening of the container, said liner having an internal edge defining a hole;

(C) a valve located at said closure access passage, said valve having:

(i) a closed configuration for occluding said access passage; and (ii) an open configuration for permitting communication between the interior and the exterior of the container through said access passage; and (D) a retainer for retaining said valve at said closure base access passage, said retainer having an outer surface with at least one liner abutment extending from said outer surface for minimizing contact between said liner internal edge and the container contents when said closure is installed on the container.

2 The closure in accordance with aspect 1 in which said base and said retainer are each a separate, unitary molded structure.

3. The closure in accordance with any of the preceding aspects 1-2 in which said valve is a flexible, resilient, and self-sealing valve.

4. The closure in accordance with any of the preceding aspects 1-3 in which said retainer has a plurality of said liner abutments.

5. The closure in accordance with any of the preceding aspects 1-4 in which said liner abutment has a generally rounded shape.

6. The closure in accordance with any of the preceding aspects 1-5 in which said retainer has an annular shoulder for limiting axially outward movement of said liner.

7. The closure in accordance with any of the preceding aspects 1-6 in which said liner has a metallic component.

8. The closure in accordance with any of the preceding aspects 1-7 further comprising a lid hingedly connected to said base.

9. The closure in accordance with any of the preceding aspects 1-8 in which said liner further comprises:

(A) a peripheral portion for being sealed to the container at the opening of the container; and (B) a cantilevered, internal portion for partially occluding the opening of the container.

10. The closure in accordance with any of the preceding aspects 1-9 in which said liner is an annulus; and said cantilevered, internal portion has a greater radial length than said peripheral portion.

11. The closure in accordance with any of the preceding aspects 1-10 in which said cantilevered, internal portion has a radial length that is at least three times greater than the radial length of said peripheral portion.

12. The closure in accordance with any of the preceding aspects 1-11 in which (A) said retainer has a generally hollow, cylindrical configuration having an axially outward open end and an axially inward open end;

(B) said liner abutment is located on said retainer external surface proximate said axially inward open end of said retainer.

13. The closure in accordance with any of the preceding aspects 1-12 in which said retainer has a generally frustoconical valve seat for confronting a portion of said valve when said valve is installed in said closure.

14. The closure in accordance with any of the preceding aspects 1-13 in which said retainer has a tapered surface that extends radially inwardly below said liner abutment for accommodating installation of said liner on said retainer.

It will be readily apparent from the foregoing detailed description of the invention and from the illustrations thereof that numerous variations and modifications may be effected without departing from the true spirit and scope of the novel concepts or principles of this invention.

What is claimed is:

1. A closure for a container having an opening to the interior of the container wherein contents may be stored, said closure comprising:

(A) a base having open ends defining an access passage extending between said open ends, said base accommodating installation at the opening of the container interior to permit communication between the container interior and the exterior of the container;

(B) a liner, that is separate from said closure base, for being disposed between said closure base and the opening of the container, said liner having an internal edge defining a hole;

(C) a valve located at said closure access passage, said valve having:

(i) a closed configuration for occluding said access passage; and (ii) an open configuration for permitting communication between the interior and the exterior of the container through said access passage; and (D) a retainer for retaining said valve at said closure base access passage, said retainer having an outer surface with at least one liner abutment extending from said outer surface for minimizing contact between said liner internal edge and the container contents when said closure is installed on the container.

2. The closure in accordance with claim 1 in which said base and said retainer are each a separate, unitary molded structure.

3. The closure in accordance with claim 1 in which said valve is flexible, resilient, and self-sealing valve.

4. The closure in accordance with claim 1 in which said retainer has a plurality of said liner abutments.

5. The closure in accordance with claim 1 in which said liner abutment has a generally rounded shape.

6. The closure in accordance with claim 1 in which said retainer has an annular shoulder for limiting axially outward movement of said liner.

7. The closure in accordance with claim 1 in which said liner has a metallic component.

8. The closure in accordance with claim 1 further comprising a lid hingedly connected to said base.

9. The closure in accordance with claim 1 in which said liner further comprises:

(A) a peripheral portion for being sealed to the container at the opening of the container; and (B) a cantilevered, internal portion for partially occluding the opening of the container.

10. The closure in accordance with claim 9 in which said liner is an annulus; and said cantilevered, internal portion has a greater radial length than said peripheral portion.

11. The closure in accordance with claim 10 in which said cantilevered, internal portion has a radial length that is at least three times greater than the radial length of said peripheral portion.

12. The closure in accordance with claim 1 in which (A) said retainer has a generally hollow, cylindrical configuration having an axially outward open end and an axially inward open end;

(B) said liner abutment is located on said retainer external surface proximate said axially inward open end of said retainer.

13. The closure in accordance with claim 1 in which said retainer has a generally frustoconical valve seat for confronting a portion of said valve when said valve is installed in said closure base.

14. The closure in accordance with claim 1 in which said retainer has a tapered surface that extends radially inwardly below said liner abutment for accommodating installation of said liner on said retainer.

15. The closure in accordance with claim 1 in which said liner is a planar membrane that includes a) a peripheral portion for being sealed to a container at the opening of the container; and b) a cantilevered, internal portion for partially occluding the opening of the container; and wherein said internal edge is defined by said cantilevered, internal portion and is engaged with said retainer exterior surface at locations outwardly of said at least one liner abutment when said closure is installed on a container, and said at least one liner abutment is located so as to at least inhibit movement of said internal edge into a product flowing from the container.

* * * * *